United States Patent [19]

Brown

[11] 4,226,443

[45] Oct. 7, 1980

[54] MULTI-MONTH CALENDAR

[76] Inventor: William T. Brown, Fayetteville, N.C.

[21] Appl. No.: 925,278

[22] Filed: Jul. 17, 1978

[51] Int. Cl.[2] ..... B42D 5/04

[52] U.S. Cl. ..... 283/2; 40/107; 40/110

[58] Field of Search ..... 283/2; 40/107, 110

[56] References Cited

U.S. PATENT DOCUMENTS

| | | | |
|---|---|---|---|
| 237,584 | 2/1881 | Ogle | 40/107 X |
| 442,337 | 12/1890 | Ryer | 40/107 X |
| 1,537,891 | 5/1925 | Shedd | 283/2 |

*Primary Examiner*—Paul A. Bell

*Attorney, Agent, or Firm*—Mills & Coats

[57] ABSTRACT

In abstract a preferred embodiment of this invention is a multi-month calendar wherein a single sight includes a plurality of months, each color coded for ready recognition.

6 Claims, 5 Drawing Figures

1979
JAN
FEB
MAR
APR
SUNDAY
MONDAY
TUESDAY
WEDNESDAY
THURSDAY
FRIDAY
SATURDAY
11
12
13
14
15
16
17
18

MULTI-MONTH CALENDAR

FIELD OF INVENTION

This invention relates to date determining devices and more particularly to multi-month calendars.

BACKGROUND OF INVENTION

In the past calendars have generally been prepared in two forms, first the calendar with all twelve months showing on the face of the same and secondly individual pages for each month, usually with the month before and the month after being shown in fine print on the same sheet.

The disadvantages of these two widely used forms of calendars are that in the twelve-month calendar, when printed in a handy size they have such fine print that they can only be read at close range or, conversely, if the print is large enough to read from any distance, the overall size of the calendar becomes measured in feet rather than inches. To overcome this problem, the single sheet per month calendar was developed which can be made in a relatively handy size and legible without eye strain; however, the months before and after are then not available. An attempt to overcome this problem has been the placing of a small calendar on the same sheet for the month before and the month after. The problem here, of course, is that this takes additional space plus the month before and the month after are usually of such fine print that they are difficulty to read except at a very close range.

A third type of calendar, which to Applicant's knowledge has been never commercially produced, includes a single month calendar with the days printed in standard blocks with the corresponding day of the month before and the month after printed in small letters in the same block. This is extremely confusing to use with three or more date numbers in the same block with no ready reference as to which number is which.

SUMMARY OF INVENTION

After much research and study into the above mentioned problems, the present invention has been developed to provide a multi-month calendar in the space of a single month sheet. This multi-month calendar is color coded so that each month will stand out by itself and can quickly and readily be recognized by the user thereof. Thus once a person has checked and is aware of the color code for the month he is interested in, he can immediately determine any given day of the month without confusion with the other month dates indicated in the same block.

In view of the above, it is an object of the present invention to provide a multi-month, single sight calendar with color coding for each month.

Another object of the present invention is to provide a multi-month calendar in a single calendar sight which is attractive to behold and simple to use.

Another object of the present invention is to provide a multi-month calendar in a single month sight which is aesthetically appealing.

Another object of the present invention is to provide a readily readable multi-month calendar in the space of a single month sight.

Other objects and advantages of the present invention will become apparent and obvious from a study of the following description and the accompanying drawings which are merely illustrative of such invention.

DETAILED DESCRIPTION OF INVENTION

With further reference to the drawings, the normal single-month sight indicated at 11 includes a plurality of day blocks 12. Each of these blocks is divided into a plurality of date divisions 13. Each similar positioned date division 13 in each of the date blocks 12 is colored with the same color.

Figure 1:
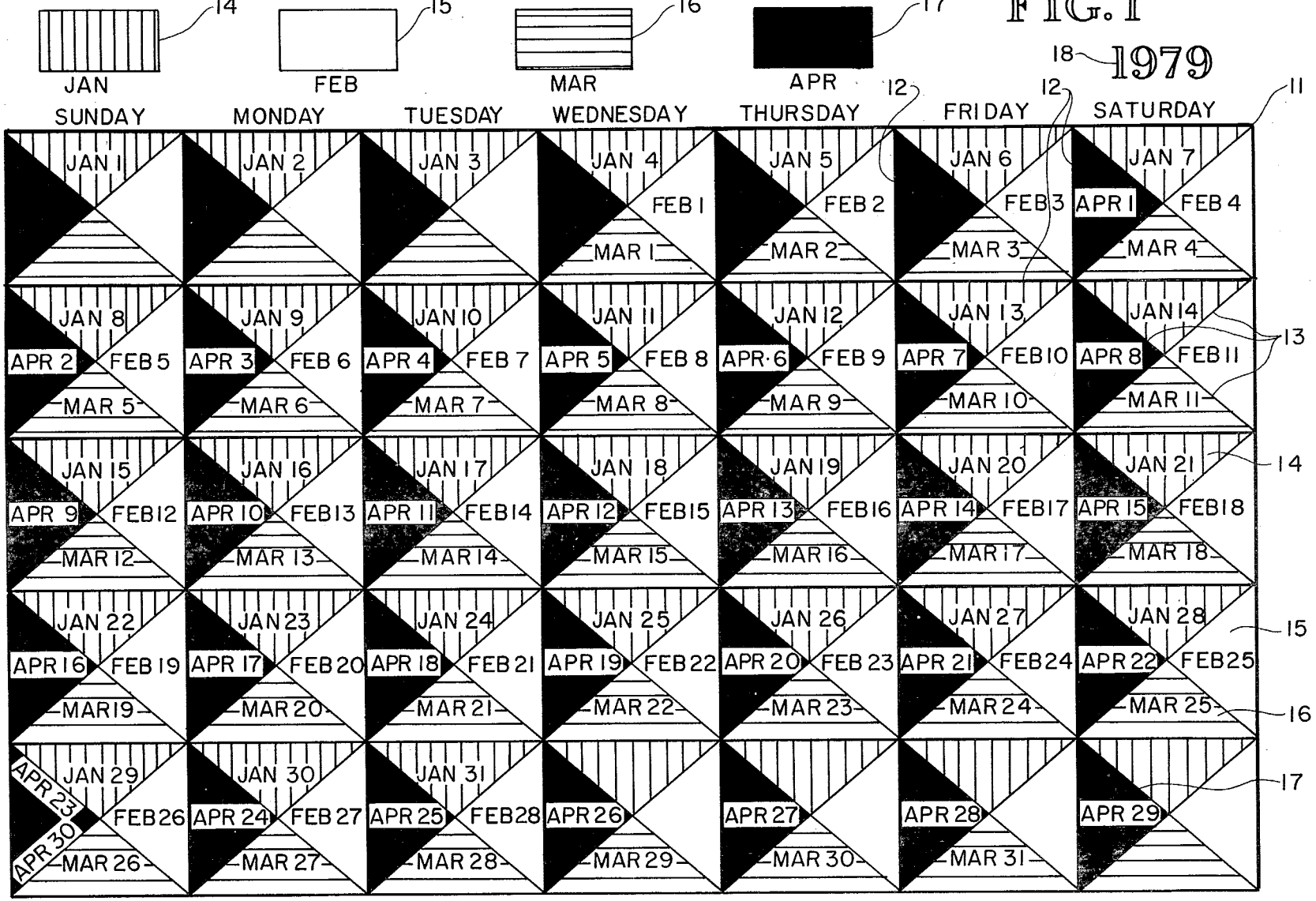
FIG. 1 is a plan view of the four-month calendar of the present invention in a one-month sight.

As exemplified in FIG. 1 and color coded as the upper portion thereof, January is color coded for red as indicated at 14, February is color coded for white as indicated at 15, March is color coded for blue as indicated at 16, and April is color coded for black as indicated at 17. The year date of the calendar shown in FIG. 1 is, of course, indicated at 18.

In a similar manner to a radio operator being able to accurately copy a morse code message on a frequency where two or more other messages are being simultaneously transmitted but at different tones, the user of the calendar of the present invention, if the month is for example March, will only be aware of the blue color divisions 16 and the dates therein and will be undistracted by the other dates in each of the date blocks 12. When the next month rolls around, the user of the calendar will become aware of the black date divisions 17 for April and at a glance will be able to tell the day of the month and again without being distracted by the other three colored dates in each of the day blocks 12.

In using calendars of the type shown in FIG. 1, great savings in not only space and printing cost but also in paper can be achieved. With wood products becoming more and more scarce, this savings of a basic commodity can contribute substantially over a period of time to efforts to conserve our natural resources.

Figure 2:
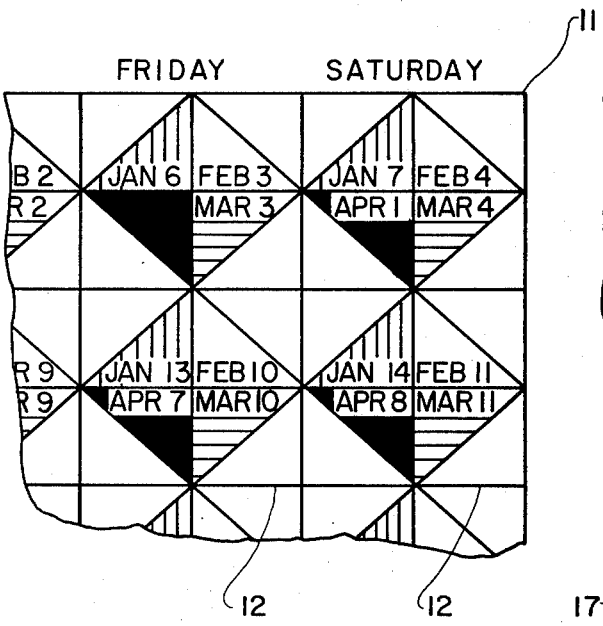
FIG. 2 is fragmentary plan view of another form of the four-month calendar in a one-month sight.

The alternate form of the present invention shown in FIG. 2 is a modified triangular four-month date division but still incorporates the red, white, blue and black color codings.

Figure 3:
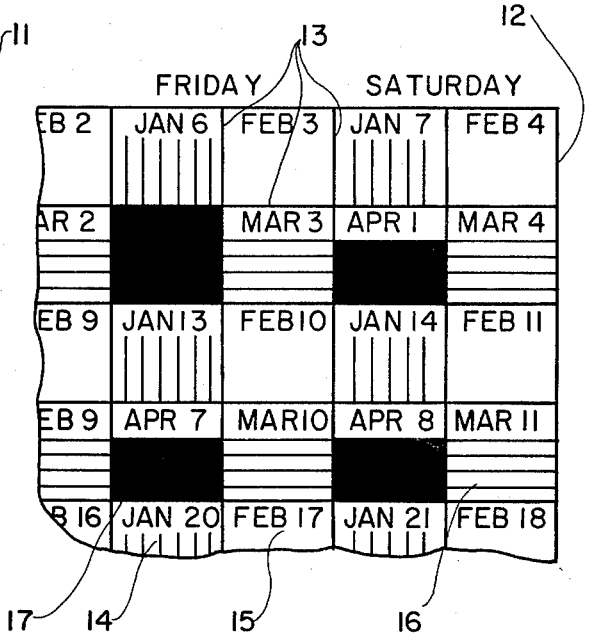
FIG. 3 is a fragmentary plan view of an even further form of a four-month single sight calendar.

The modification of FIG. 3 is again a four-month calendar in a single day sight utilizing the same color coding but in block date division form rather than triangular form.

Figure 4:
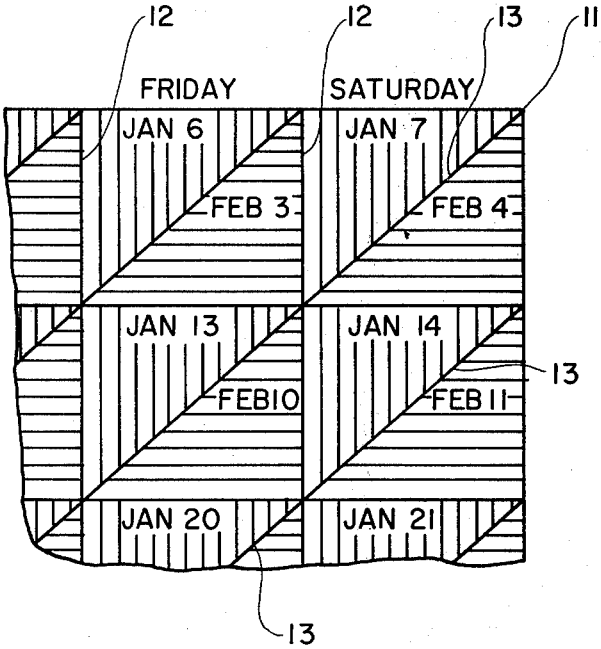
FIG. 4 is a fragmentary plan view of a two-month calendar in a single month sight.

The modification of FIG. 4 is, of course, of interest in that it is a two-month calendar using red and blue color coding for the date division 13 of the date blocks 12.

Figure 5:
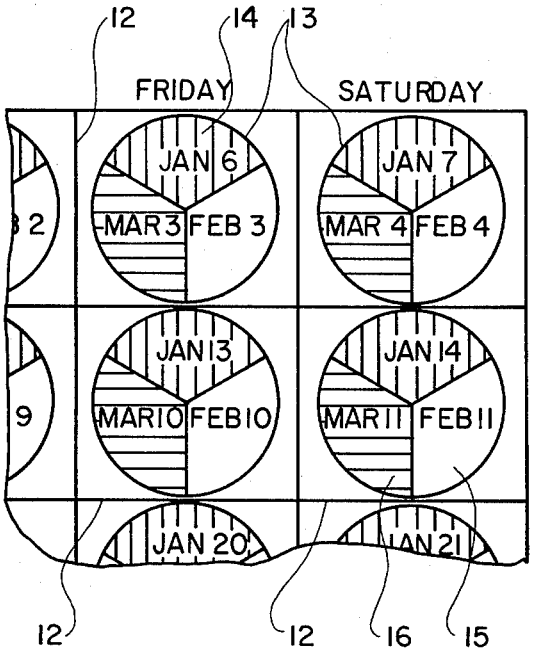
FIG. 5 is a fragmentary plan view of a three-month calendar in a single month sight.

FIG. 5 gives a quarter year calendar in a single sight with any given three-month period being color coded, for example, as red, white and blue.

Numerous other geometrical date divisions 13 can be envisioned for each of the date blocks 12 without departing from the spirit of the present invention. It is, of course, intended that these other geometrical date divisions be included within the scope of the present invention.

From the above, it can be seen that the present invention has the advantage of providing, in a single sight, a multi-month calendar which can readily be recognized and each month quickly and easily distinguished from the other months through single color awareness of the user of the same.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An improved calendar comprising: a plurality of day blocks arranged in rows seven across and five down to give a total of thirty-five blocks within the confines of a rectangular space; at least two different colored date divisions within each day block, each of said color division of each day block being substantially identical to a color division in each of the other day blocks; and equa-sized numeral indicia indicating successive calendar days displayed in successive adjacent same color divisions whereby a multi period calendar is provided within the normal space and sight of a single period calendar.

2. The calendar of claim 1 wherein at least three date divisions are provided within each day block.

3. The calendar of claim 1 wherein at least four date divisions are provided within each day block.

4. The calendar of claim 1 wherein each of the date divisions within any given day block are triangular.

5. The calendar of claim 1 wherein each of the date divisions within any given day block are square.

6. The calendar of claim 1 wherein each of the date divisions within any given day block are pie shaped.

* * * * *